US010735880B2

(12) United States Patent
Little

(10) Patent No.: US 10,735,880 B2
(45) Date of Patent: Aug. 4, 2020

(54) SYSTEMS AND METHODS OF FORMING AUDIO TRANSDUCER DIAPHRAGMS

(71) Applicant: Sonos, Inc., Santa Barbara, CA (US)

(72) Inventor: Richard Warren Little, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 388 days.

(21) Appl. No.: 15/590,329

(22) Filed: May 9, 2017

(65) Prior Publication Data

US 2018/0332419 A1 Nov. 15, 2018

(51) Int. Cl.

| | |
|---|---|
| ***H04R 31/00*** | (2006.01) |
| ***B21D 28/26*** | (2006.01) |
| ***H04R 7/02*** | (2006.01) |
| *H04R 7/12* | (2006.01) |

(52) U.S. Cl.

CPC ..... *H04R 31/003* (2013.01); *B21D 28/26* (2013.01); *H04R 7/02* (2013.01); *H04R 31/00* (2013.01); *H04R 7/12* (2013.01)

(58) Field of Classification Search

CPC ..... H04R 31/003; H04R 31/00; H04R 7/02; H04R 7/12; B21D 28/26

See application file for complete search history.

(56) References Cited

U.S. PATENT DOCUMENTS

| | | | | |
|---|---|---|---|---|
| 1,989,015 | A * | 1/1935 | McKellip | H04R 31/003 264/322 |
| 2,105,934 | A * | 1/1938 | Stevens | H04R 9/043 381/405 |
| 5,440,644 | A | 8/1995 | Farinelli et al. | |
| 5,761,320 | A | 6/1998 | Farinelli et al. | |
| 5,923,902 | A | 7/1999 | Inagaki | |
| 6,032,202 | A | 2/2000 | Lea et al. | |
| 6,256,554 | B1 | 7/2001 | DiLorenzo | |
| 6,404,811 | B1 | 6/2002 | Cvetko et al. | |
| 6,469,633 | B1 | 10/2002 | Wachter | |
| 6,522,886 | B1 | 2/2003 | Youngs et al. | |
| 6,611,537 | B1 | 8/2003 | Edens et al. | |
| 6,631,410 | B1 | 10/2003 | Kowalski et al. | |
| 6,757,517 | B2 | 6/2004 | Chang | |
| 6,778,869 | B2 | 8/2004 | Champion | |
| 6,792,127 | B1 * | 9/2004 | Anthony | H04R 7/12 381/407 |

(Continued)

FOREIGN PATENT DOCUMENTS

| | | |
|---|---|---|
| EP | 1389853 A1 | 2/2004 |
| WO | 200153994 | 7/2001 |
| WO | 2003093950 A2 | 11/2003 |

OTHER PUBLICATIONS

AudioTron Quick Start Guide, Version 1.0, Mar. 2001, 24 pages.
AudioTron Reference Manual, Version 3.0, May 2002, 70 pages.
AudioTron Setup Guide, Version 3.0, May 2002, 38 pages.
Bluetooth. "Specification of the Bluetooth System: The ad hoc SCATTERNET for affordable and highly functional wireless connectivity," Core, Version 1.0 A, Jul. 26, 1999, 1068 pages.

(Continued)

*Primary Examiner* — Peter Dungba Vo
*Assistant Examiner* — Jeffrey T Carley

(57) ABSTRACT

Systems and methods of forming transducer diaphragms are disclosed herein. In one embodiment, a method of producing a transducer diaphragm includes receiving a workpiece between a first forming tool and a second forming tool. The workpiece can have an inner boundary defining a central aperture. The workpiece with the aperture is compressed between the first and second forming tools to form the transducer diaphragm.

19 Claims, 8 Drawing Sheets

(56) References Cited

U.S. PATENT DOCUMENTS

| | | | | |
|---|---|---|---|---|
| 7,130,608 | B2 | 10/2006 | Hollstrom | |
| 7,130,616 | B2 | 10/2006 | Janik | |
| 7,143,939 | B2 | 12/2006 | Henzerling | |
| 7,236,773 | B2 | 6/2007 | Thomas | |
| 7,295,548 | B2 | 11/2007 | Blank et al. | |
| 7,391,791 | B2 | 6/2008 | Balassanian et al. | |
| 7,483,538 | B2 | 1/2009 | McCarty et al. | |
| 7,571,014 | B1 | 8/2009 | Lambourne et al. | |
| 7,630,501 | B2 | 12/2009 | Blank et al. | |
| 7,643,894 | B2 | 1/2010 | Braithwaite et al. | |
| 7,657,910 | B1 | 2/2010 | McAulay et al. | |
| 7,853,341 | B2 | 12/2010 | McCarty et al. | |
| 7,987,294 | B2 | 7/2011 | Bryce et al. | |
| 8,014,423 | B2 | 9/2011 | Thaler et al. | |
| 8,021,950 | B1 * | 9/2011 | Abadeer | H01L 21/268 257/E21.241 |
| 8,045,952 | B2 | 10/2011 | Qureshey et al. | |
| 8,103,009 | B2 | 1/2012 | McCarty et al. | |
| 8,234,395 | B2 | 7/2012 | Millington et al. | |
| 8,483,853 | B1 | 7/2013 | Lambourne | |
| 8,942,252 | B2 | 1/2015 | Balassanian et al. | |
| 2001/0042107 | A1 | 11/2001 | Palm | |
| 2002/0022453 | A1 | 2/2002 | Balog et al. | |
| 2002/0026442 | A1 | 2/2002 | Lipscomb et al. | |
| 2002/0124097 | A1 | 9/2002 | Isely et al. | |
| 2003/0157951 | A1 | 8/2003 | Hasty | |
| 2004/0024478 | A1 | 2/2004 | Hans et al. | |
| 2005/0111673 | A1 * | 5/2005 | Rosen | B60R 11/0217 381/89 |
| 2005/0145846 | A1 * | 7/2005 | Brandenburger | H01L 21/563 257/71 |
| 2007/0142944 | A1 | 6/2007 | Goldberg et al. | |
| 2010/0047971 | A1 * | 2/2010 | Hua | H01L 24/92 438/122 |
| 2016/0295331 | A1 * | 10/2016 | Fehervari | H04R 7/125 |

OTHER PUBLICATIONS

Bluetooth. "Specification of the Bluetooth System: Wireless connections made easy," Core, Version 1.0 B, Dec. 1, 1999, 1076 pages.

Dell, Inc. "Dell Digital Audio Receiver: Reference Guide," Jun. 2000, 70 pages.

Dell, Inc. "Start Here," Jun. 2000, 2 pages.

"Denon 2003-2004 Product Catalog," Denon, 2003-2004, 44 pages.

Jo et al., "Synchronized One-to-many Media Streaming with Adaptive Playout Control," Proceedings of SPIE, 2002, pp. 71-82, vol. 4861.

Jones, Stephen, "Dell Digital Audio Receiver: Digital upgrade for your analog stereo," Analog Stereo, Jun. 24, 2000 retrieved Jun. 18, 2014, 2 pages.

Louderback, Jim, "Affordable Audio Receiver Furnishes Homes With MP3," TechTV Vault. Jun. 28, 2000 retrieved Jul. 10, 2014, 2 pages.

Palm, Inc., "Handbook for the Palm VII Handheld," May 2000, 311 pages.

Presentations at WinHEC 2000, May 2000, 138 pages.

U.S. Appl. No. 60/490,768, filed Jul. 28, 2003, entitled "Method for synchronizing audio playback between multiple networked devices," 13 pages.

U.S. Appl. No. 60/825,407, filed Sep. 12, 2006, entitled "Controlling and manipulating groupings in a multi-zone music or media system," 82 pages.

UPnP; "Universal Plug and Play Device Architecture," Jun. 8, 2000; version 1.0; Microsoft Corporation; pp. 1-54.

Yamaha DME 64 Owner's Manual; copyright 2004, 80 pages.

Yamaha DME Designer 3.5 setup manual guide; copyright 2004, 16 pages.

Yamaha DME Designer 3.5 User Manual; Copyright 2004, 507 pages.

* cited by examiner

SYSTEMS AND METHODS OF FORMING AUDIO TRANSDUCER DIAPHRAGMS

FIELD OF THE DISCLOSURE

The disclosure is generally related to consumer goods and, more particularly, to methods, systems, products, features, services, and other elements directed to forming transducers, including transducer diaphragms and/or another aspect thereof.

BACKGROUND

An audio transducer includes a cone or diaphragm that moves in response to electrical signals to produce acoustic energy (e.g., sound). Diaphragms can be made of various materials such as, for example, paper, metal, ceramics, etc. A conventional metal speaker diaphragm, for example, can be made from a sheet metal blank that is stamped into a frustum or cone shape. A center hole is punched out of the stamped cone creating an inner boundary of the cone. In many instances, however, a conventional metal cone forming process can stretch and stress metal material near the center of the cone, resulting in a cone sidewall with unsuitably large thickness variations and an increased likelihood of tearing of the inner boundary.

BRIEF DESCRIPTION OF THE DRAWINGS

Features, aspects, and advantages of the presently disclosed technology may be better understood with respect to the following description, appended claims, and accompanying drawings where:

Figure 1:
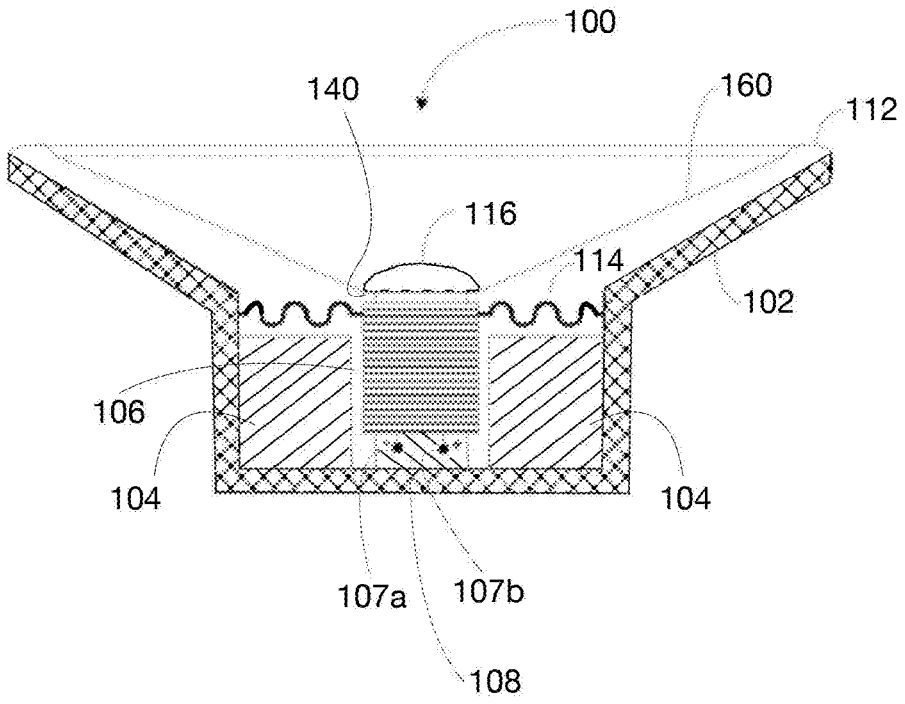
FIG. 1 is a cross-sectional side view of a transducer assembly configured in accordance with an embodiment of the disclosed technology.

The drawings are for the purpose of illustrating example embodiments, but it is understood that the inventions are not limited to the arrangements and instrumentality shown in the drawings.

DETAILED DESCRIPTION

I. Overview

Systems and methods of forming transducer diaphragms are disclosed herein. In one embodiment, for example, a method of producing a transducer diaphragm can include receiving a workpiece between a first forming tool and a second forming tool. The workpiece may include an inner boundary defining an aperture (e.g., a hole, gap, opening, etc.). The first forming tool and the second forming tool compress the workpiece therebetween, thereby deforming the workpiece and forming the transducer diaphragm. In some embodiments, before the workpiece is received between the first and second forming tools, the center aperture is formed by punching out a center portion of the workpiece. In some embodiments, the resulting transducer diaphragm has a generally elliptical frustum shape and/or a frusto-conical shape. In certain embodiments, the transducer diaphragm has a rotationally asymmetric shape. In some embodiments, the diameter of the center aperture is increased from a first diameter to a second, greater diameter after the workpiece is compressed between first and second forming tools. In certain embodiments, the workpiece comprises a metal such as, for example, aluminum, magnesium, titanium, and/or an alloy thereof. In further embodiments, the workpiece may comprise another suitable metal. In some embodiments, the transducer diaphragm has a side wall having a range of thicknesses including a minimum thickness and a maximum thickness in which the minimum thickness is a predetermined percentage (e.g., 85%, 88%, 90%, 92%, 95%, 98%, etc.) of the maximum thickness.

In another embodiment, a method of forming a loudspeaker diaphragm includes removing a center portion of a workpiece to form an unfinished loudspeaker diaphragm having a center aperture. The method further includes compressing the unfinished loudspeaker diaphragm between a first forming tool and a second forming tool to form the loudspeaker diaphragm. In some embodiments, for example, the loudspeaker diaphragm has a generally elliptical frustum shape. In certain embodiments, the loudspeaker diaphragm may have a rotationally asymmetric shape. In some embodiments, a diameter of the center aperture in the loudspeaker diaphragm increases from a first diameter to a second, greater diameter after the loudspeaker diaphragm is formed. In some embodiments, compressing the unfinished loudspeaker diaphragm comprises moving the first forming tool with respect to the second forming tool. In one embodiment, for example, a forming portion of the first forming tool is axially aligned with the center aperture and the forming portion of the first forming tool moves toward the center aperture when the unfinished loudspeaker diaphragm is compressed between the first and second forming tools. In some embodiments, the removed center portion of the workpiece comprises one or more apertures having a generally circular shape. In certain embodiments, the removed center portion of the workpiece one or more apertures having a generally symmetric polygonal shape. In other embodiments, however, the removed center portion one or more apertures having an asymmetric polygonal shape. In further embodiments, the removed center portion comprises one or more slits formed in the workpiece.

In yet another embodiment, a method of constructing an audio transducer assembly includes forming a transducer diaphragm by compressing a metal workpiece having a center aperture between a first forming tool and a second forming tool. The metal workpiece can include, for example, an inner boundary defining a center aperture. The method further includes attaching the diaphragm to a frame having a magnet, and operably coupling the diaphragm to a coil of wire surrounded by the magnet. The coil of wire is electrically connected to an electrical signal source, and is configured to actuate the diaphragm in response to electrical signals received from the electrical signal source. In some embodiments, prior to forming the diaphragm, removing the center portion of the metal membrane, thereby forming the center aperture. In certain embodiments, after forming the diaphragm, a diameter of the center aperture in the loudspeaker diaphragm is increased from a first diameter to a second, greater diameter.

Each of these example implementations may be embodied as a method, a device configured to carry out the implementation, a system of devices configured to carry out the implementation, or a non-transitory computer-readable medium containing instructions that are executable by one or more processors to carry out the implementation, among other examples. One of ordinary skill in the art will appreciate that this disclosure includes numerous other embodiments, including combinations of the example features described herein. Moreover, any example operation described as being performed by a given device to illustrate a technique may be performed by any number suitable devices, including the devices described herein.

While some examples described herein may refer to functions performed by given actors such as "users" and/or other entities, it should be understood that this description is for purposes of explanation only. The claims should not be interpreted to require action by any such example actor unless explicitly required by the language of the claims themselves.

In the Figures, identical reference numbers identify identical or at least generally similar elements. To facilitate the discussion of any particular element, the most significant digit or digits of any reference number refers to the Figure in which that element is first introduced. For example, element 160 is first introduced and discussed with reference to FIG. 1.

II. Example Transducer

FIG. 1 is a cross-sectional side view of a loudspeaker or transducer assembly 100 configured in accordance with an embodiment of the disclosed technology. The transducer assembly 100 includes a basket, a housing, or a frame 102 that houses a magnet assembly 104 (e.g., one or more permanent magnets comprising neodymium). The magnet assembly 104 surrounds a pole or a core portion 108 extending from a lower portion of the frame 102. A coil of wire 106 surrounds the core portion 108 and includes a negative terminal 107*a* and a positive terminal 107*b*. A flexible membrane or a surround 112 resiliently couples a diaphragm 160 to the frame 102. A dust cap 116 covers an aperture 140 in the diaphragm 160, protecting the voice coil 108 from external dust and other contaminants. A damper or spider 114 couples the speaker frame 102 to the voice coil 106 and maintains a concentric position of the voice coil 106 with respect to the magnet assembly 104 and an axial alignment of the voice coil 106 and the aperture 140. The spider 114 can provide a restoring force on the diaphragm 160 and the voice coil 106, thereby preventing excessive inward and/or outward movement.

In operation, the voice coil 106 receives electrical signals (e.g., audio electrical signals) from an amplifier and/or another electrical signal source (not shown) via the terminals 107*a* and 107*b*. The flow of electrical signals through the voice coil 106 forms a corresponding magnetic field. In response, the magnetic assembly 104 drives the voice coil 106 inward and outward, which correspondingly moves the diaphragm 160 inward and outward, thereby producing sound.

III. Example Method

Figure 2A:
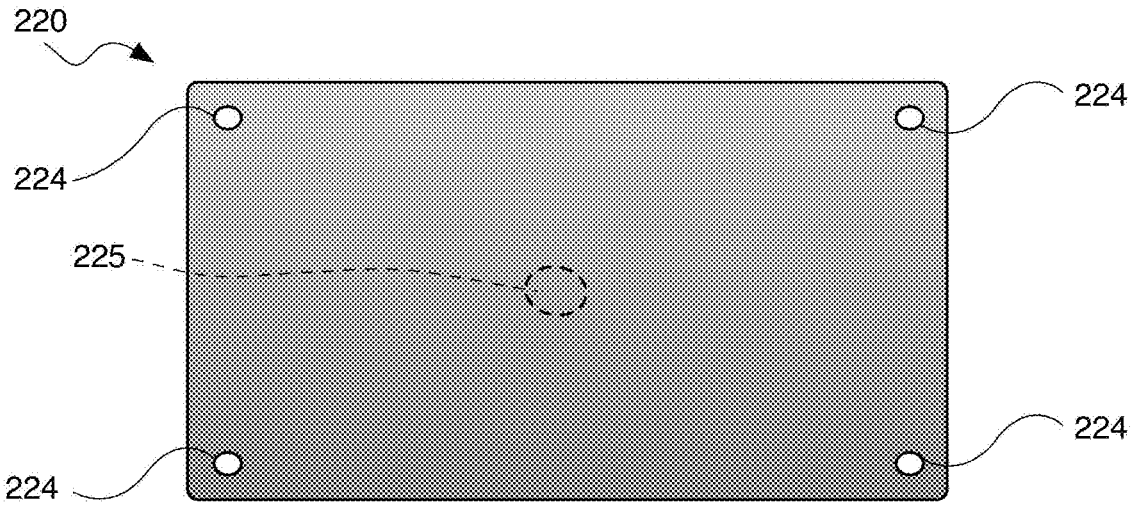
FIG. 2A is a plan view of a sheet of base material.

FIG. 2A is a plan view of a sheet 220 having a center portion 225 and comprising a base material. A plurality of holes 224 in the sheet can aid alignment of the sheet 220 on a die during manufacturing into a product (e.g., a metal transducer diaphragm). In some embodiments, the base material comprises a metal capable of being formed into sheet such as, for example, aluminum, brass, copper, steel, tin, nickel, titanium, and/or an alloy thereof. In other embodiments, the base material may comprise another metal, such as, for example, magnesium, beryllium, and/or an alloy thereof. In some embodiments, the sheet 220 can have a thickness of 0.5 mm or less (e.g., a thickness between about 0.05 mm and 0.5 mm, between about 0.1 mm and 0.20 mm, or between about 0.12 mm and 0.15 mm). In other embodiments, the sheet 220 can have any suitable thickness. Moreover, in the illustrated embodiment of FIG. 2A, the sheet 220 has a generally rectangular shape. In other embodiments, however, the sheet 220 can have another suitable shape (e.g., a circle, ellipse, square, triangle, trapezoid, hexagon, octagon).

Figure 2B:
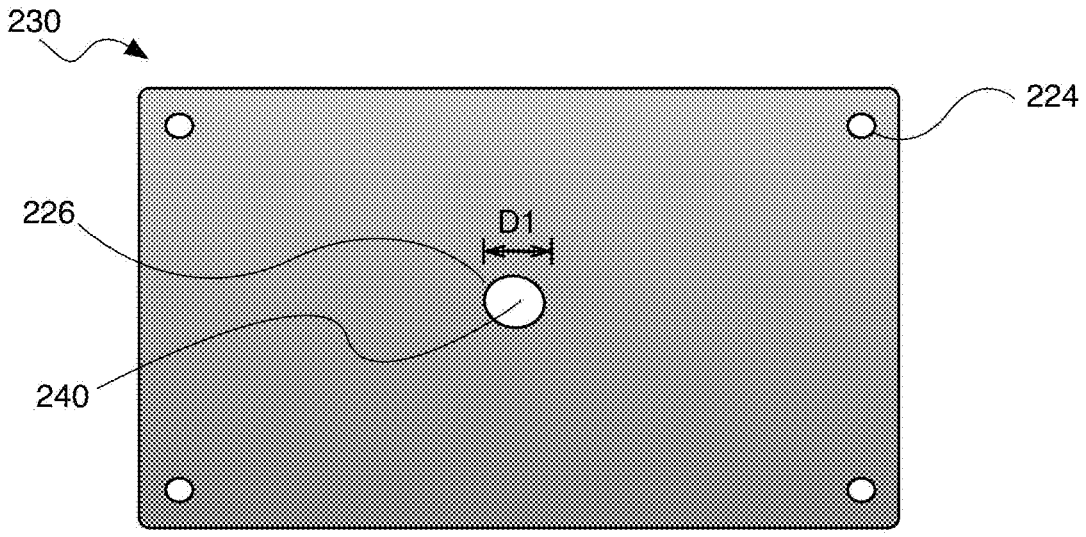
FIG. 2B is a plan view of a workpiece configured in accordance with an embodiment of the disclosed technology.
Figure 3:
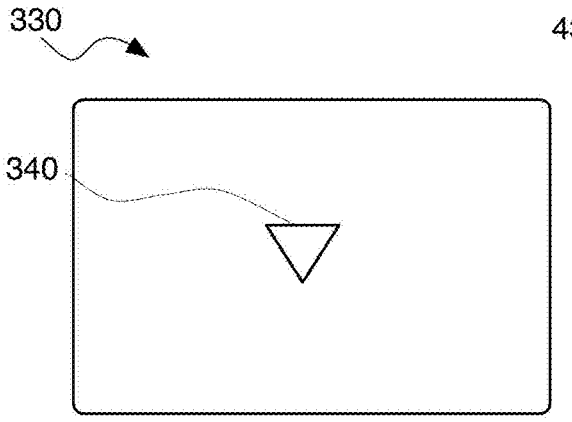
FIGS. 3-8 are schematic plan views of workpieces configured in accordance with additional embodiments of the disclosed technology.
Figure 4:
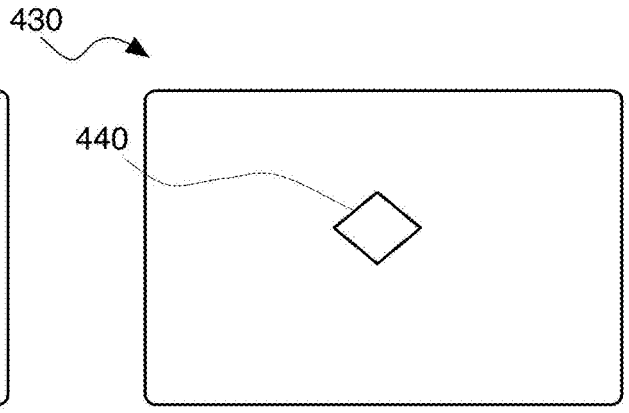
Figure 5:
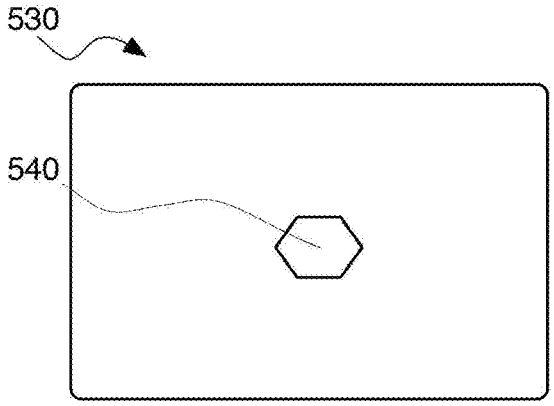
Figure 6:
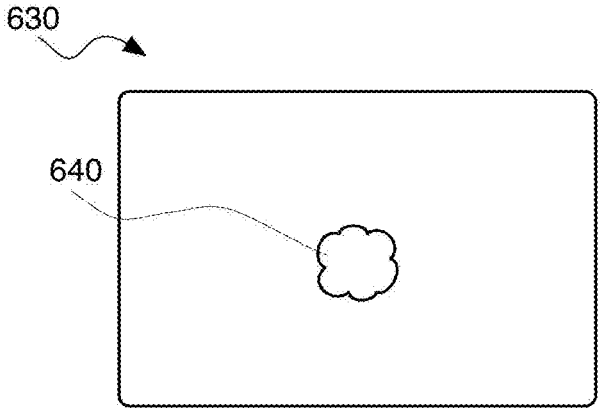
Figure 7:
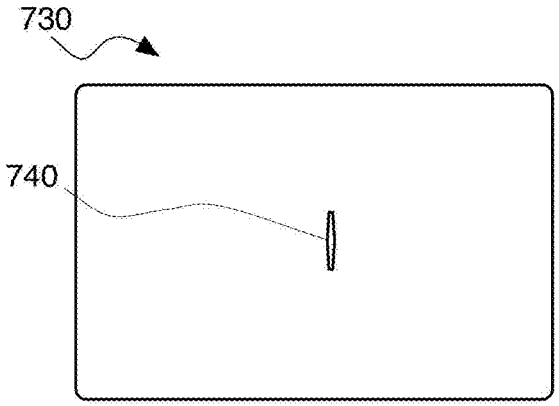

FIG. 2B is a plan view of a workpiece 230 comprising the sheet 220 and including an inner boundary 226 defining a center aperture 240 (e.g., one or more holes, gaps, openings in a center region of the workpiece 230) formed in the workpiece 230. The center aperture 240 can be formed, for example, by cutting, punching, or otherwise removing the center portion 225 (FIG. 2A) from the sheet 220. In the illustrated embodiment of FIG. 2B, the center aperture 240 comprises a circular hole in the workpiece 230 having a dimension D1 (e.g., a diameter) between about 1 mm and about 100 mm (e.g., between about 10 mm and about 100 mm). As described below, in other embodiments, the workpiece 230 can comprise one or more apertures having any suitable shape and/or size.

FIGS. 3-7 are schematic plan views of corresponding workpieces 330, 430, 530, 630, and 730 configured in accordance with additional embodiments of the disclosed technology. Referring to FIGS. 3-7, together, the workpieces 330, 430, 530, 630, and 730 can be made from the sheet 220 as discussed above in reference to FIG. 2B. The workpiece 330 includes a center aperture 340 having polygonal shape (e.g., a triangle). The workpiece 430 includes a center aperture 440 having a rhombus, diamond, and/or parallelogram shape. The workpiece 530 includes a hexagonal center aperture 540. The workpiece 630 includes an irregular center aperture 640 (e.g., a cloud shape). The workpiece 730 includes a center aperture 740 comprising a slit.

Figure 8:
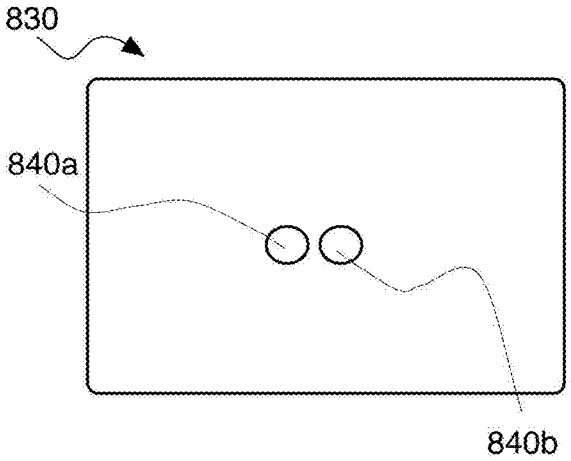

FIG. 8 is a schematic plan view of a workpiece 830 configured in accordance with another embodiment of the disclosed technology. The workpiece 830 includes a plurality of apertures 840 (identified separately as a first aperture 840*a* and a second aperture 840*b*. In the illustrated embodiment of FIG. 8, the workpiece 830 include two apertures 840. In other embodiments, however, the workpiece 830 can include three or more apertures 840. In some embodiments, the apertures 840 are positioned at locations in the workpiece 830 other than a center region.

Figure 9A:
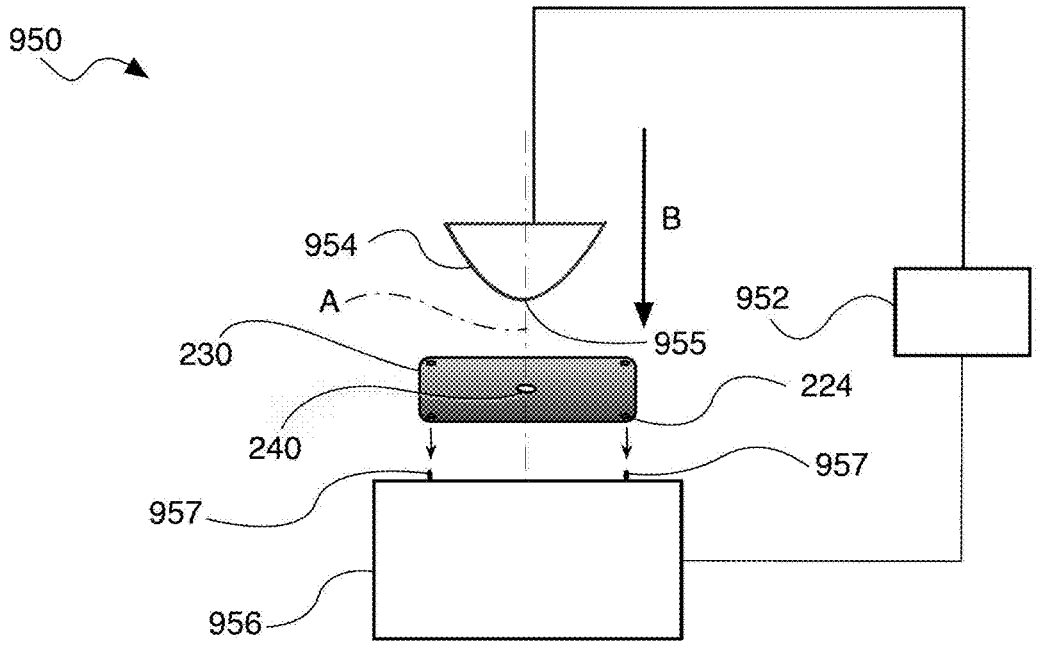
FIG. 9A is a schematic side view of a forming system configured in accordance with an embodiment of the disclosed technology.

FIG. 9A is a schematic side view of a diaphragm formation machine (e.g., a stamping press) or a system 950 configured in accordance with an embodiment of the disclosed technology. The system 950 may include a controller 952 configured to control the system 950. An upper die or a first forming tool 954 has a forming portion 955. A lower die or second forming tool 956 can be configured to receive and hold the workpiece 230 during forming operations (e.g., stamping, pressing, and/or another suitable metal cold forming process). A plurality of posts 957 may receive corresponding ones of the holes 224 in the workpiece 230 such that the workpiece 230 is secured on the second forming portion 956 and aligned with the first forming tool 954 and the forming portion along an axis A.

The controller 952 may include memory and one or more processors, which may take the form of a general or special-purpose processor or controller. For instance, the controller 952 may include may include microprocessors, microcontrollers, application-specific integrated circuits, digital signal processors, and the like. The memory may be data storage that can be loaded with one or more of the software components executable by the one or more processor to perform those functions. Accordingly, the memory may comprise one or more non-transitory computer-readable storage mediums, examples of which may include volatile storage mediums such as random access memory, registers, cache, etc. and non-volatile storage mediums such as read-only memory, a hard-disk drive, a solid-state drive, flash memory, and/or an optical-storage device, among other possibilities.

Figure 9B:
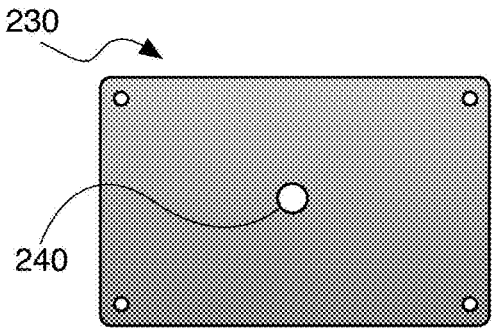
FIGS. 9B-9D are plan views of a workpiece during various forming operations.
Figure 9C:
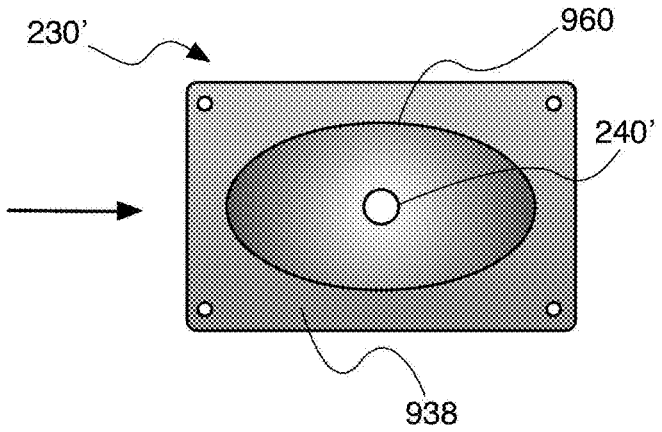

In operation, the second forming tool 956 receives and secures the workpiece 230 thereupon. The controller 952 instructs the first forming tool 954 to move toward the second forming tool 956 along an axis A in a direction indicated by arrow B. Movement of the first forming tool 954 toward the second forming tool 956 causes the forming portion 955 to engage and compress the workpiece 230 between the first forming tool 954 and the second forming tool 956. Compressing the workpiece 230 between the forming tools 954 and 956 deforms the workpiece 230, transforming it from a sheet to a desired shape as discussed below. FIGS. 9B and 9C illustrate the workpiece 230 before and after compression. FIG. 9B is a plan view of the workpiece 230. FIG. 9C is a plan view of an unfinished diaphragm or an intermediate workpiece 230' after the compression operation discussed above with reference to FIG. 9A. In the illustrated embodiment of FIG. 9C, the intermediate workpiece 230' includes a transducer diaphragm 960 (e.g., a transducer cone) formed therein and edge material 964. The intermediate workpiece 230' includes a corresponding center aperture 240' having a different size (e.g., larger diameter) with respect to the center aperture 240 as a result of the compression discussed above with reference to FIG. 9A. In some embodiments, the intermediate workpiece 230' is formed as a result of a single compression operation by the system 950. In other embodiments, the system 950 can perform a plurality of compression operations (e.g., progressive stamping and/or rolling) on the workpiece 230 to form the intermediate workpiece 230'.

Figure 9D:
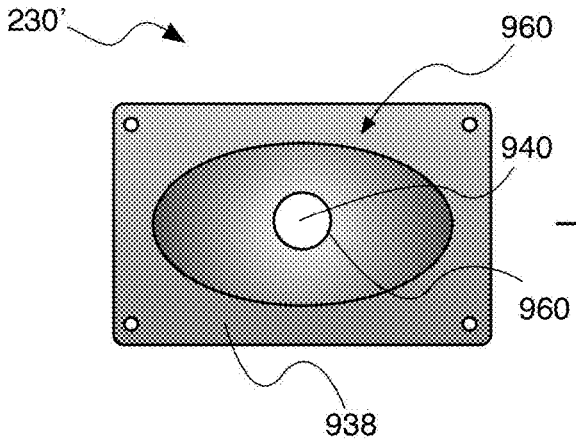

FIG. 9D is a plan view of the intermediate workpiece 230' in which the diaphragm includes a first boundary 970 (e.g., an inner boundary, circumference, and/or perimeter) defining a center aperture 940 that has an increased size with respect to the apertures 240 and 240'. In some embodiments, the center aperture 940 is formed by punching the intermediate workpiece 230' at the center aperture 240' (FIG. 9C). In other embodiments, any suitable operation (e.g., cutting) can be performed on the intermediate workpiece 230' to increase the transform the center aperture 240' to the center aperture 940.

Figure 9E:
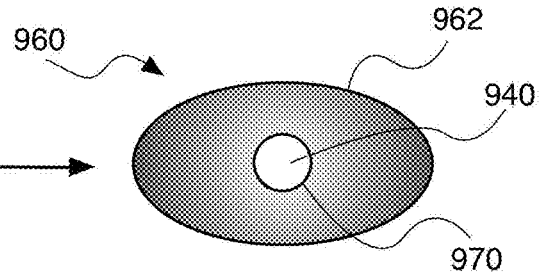
FIGS. 9E and 9F are top plan and isometric side views, respectively, of a transducer diaphragm produced in accordance with an embodiment of the disclosed technology.
Figure 9F:
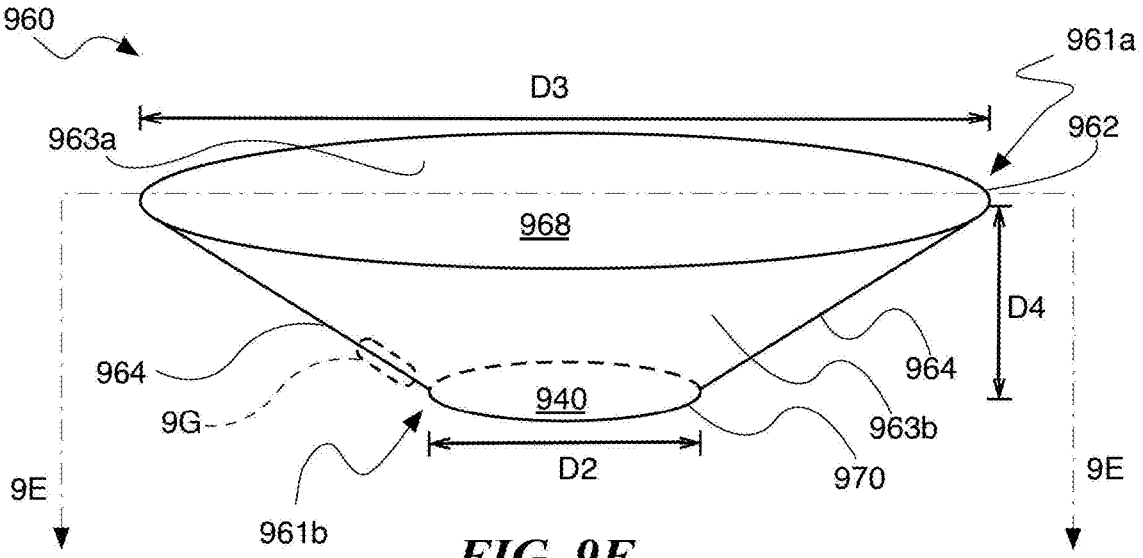
Figure 9G:
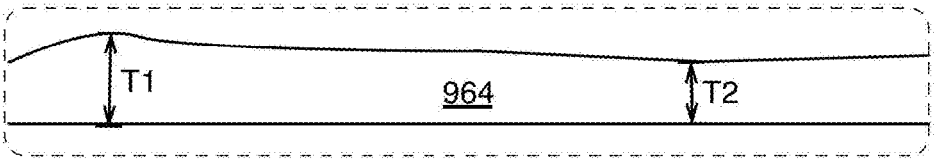
FIG. 9G is an enlarged portion of FIG. 9F.

FIG. 9E is a top plan view of the diaphragm 960 with second boundary 962 after removal of the edge material 938 of the workpiece 230'. FIG. 9F is an isometric side view of the transducer diaphragm 960. FIG. 9G is an enlarged portion of FIG. 9F. Referring to FIGS. 9E-9G together, the diaphragm 960 includes a first base portion 961*a* (e.g., an upper base) and a second base portion 961*b* (e.g., a lower base). The diaphragm 960 further includes first surface 963*a* (e.g., a forward-facing surface) opposite a second surface (e.g., a rear-facing surface). A second boundary 962 (e.g., an outer boundary, perimeter, and/or circumference) defines an opening 968 in the diaphragm 960. In the illustrated embodiment of FIG. 9F, the diaphragm 960 has a generally elliptical frustum shape. In other embodiments, the diaphragm 960 can have other suitable shapes including, for example, a frusto-conical shape, a cone shape, etc.

The first boundary 970 and the second boundary 962 have corresponding dimensions D2 and D3 (e.g., diameters, lengths, and/or widths). In some embodiments, the dimension D2 is a diameter between about 10 mm and 100 mm (e.g., between about 20 mm and about 90 mm, between about 30 mm and about 50 mm, or between about 40 mm), and the dimension D3 is a width between about 20 mm and about 500 mm (e.g., between about 25 mm and about 250 mm, between about 30 mm and about 200 mm, between about 150 mm and 180 mm, or about 170 mm). In other embodiments, the dimensions D2 and D3 can be any suitable diameter, length, or width. Moreover, D4 indicates an axial distance between the first boundary 970 and the second boundary 962. In some embodiments, for example, the distance D4 corresponds to a height of the diaphragm 960 between about 10 mm and about 100 mm (e.g., between about 20 mm and about 50 mm, between about 25 mm and about 35 mm, or about 28 mm).

One or more sidewalls 964 extend from the first boundary 970 to the second boundary 962, between the first base portion 962*a* and the second base portion 962*b*. As shown in FIG. 9G, the one or more sidewalls 964 have a range of thicknesses including a maximum or first thickness T1, and a minimum or second thickness T2. In some embodiments, for example, the range of thicknesses is between about 0.1 mm and about 0.3 mm (e.g., between about 0.135 mm and between about 0.15 mm). The first thickness T1 can be between about 0.14 mm and about 0.15 mm (e.g., between about 0.145 mm and 0.150 mm, or about 0.149 mm). The second thickness T2 can be between about 0.135 mm and about 0.145 mm (e.g., between about 0.137 mm and 0.142 mm, between about 0.139 mm and about 0.141 mm, or about 0.14 mm). In some embodiments, the second thickness T2 is a predetermined percentage (e.g., 90%) of the first thickness T1. In other embodiments, however, the predetermined percentage may be another suitable percentage (e.g., between about 80% and about 99%, between about 85% and about 98%, between about 87% and about 93%, between about 88% and 92%).

Figure 10:
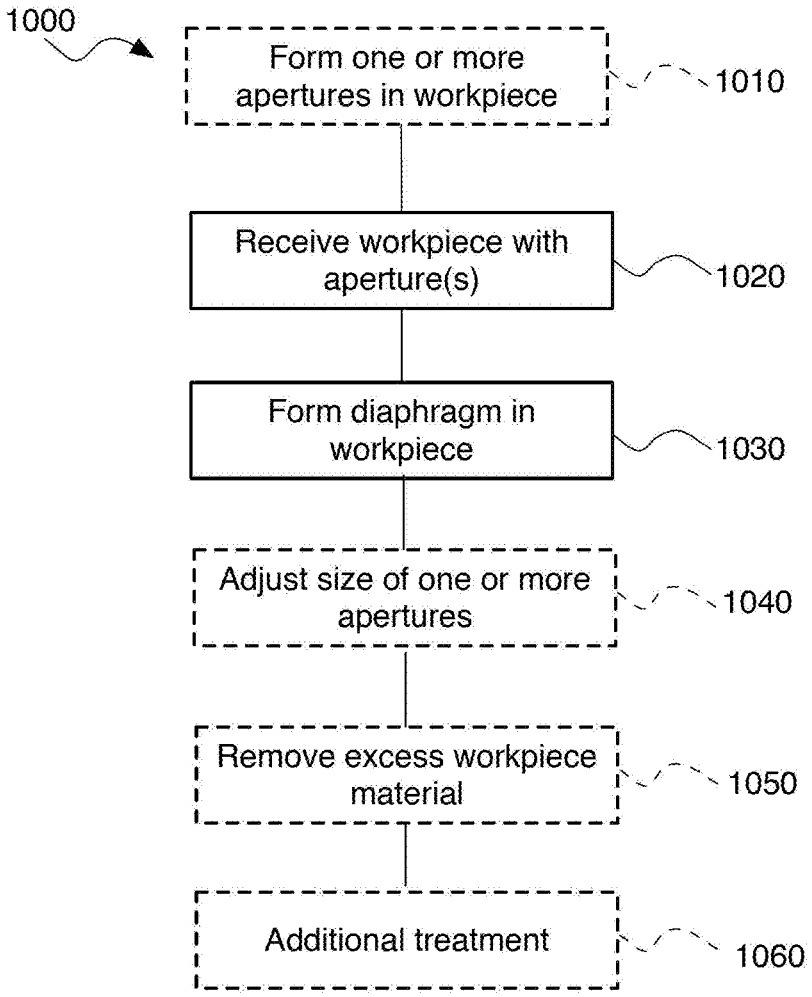
FIG. 10 is a flow diagram of a process of producing a transducer diaphragm in accordance with an embodiment of the disclosed technology.

FIG. 10 is a flow diagram of a process 1000 of producing a transducer diaphragm. In some embodiments, the process 1000 comprises instructions stored on a non-transitory computer-readable memory that, when executed by one or more processors, can cause one or more machines and/or systems (e.g., the system 950 of FIG. 9A) to perform one or more operations. In some aspects, a single machine or system can perform all the operations described below. In other aspects, the process 1000 is performed by more than one machine or system. In certain aspects, the process 1000 includes additional or fewer steps than the steps described below in reference to FIG. 10. Moreover, the steps shown in FIG. 10 do not necessarily denote an order to performing the steps.

At block 1010, the process 1000 can optionally include forming one or more apertures in a workpiece (e.g., the aperture 240 in the workpiece 230 of FIG. 2B). As discussed above with reference to FIGS. 2B-8, the one or more apertures can include any suitable shape including, for example, one or more circles, ellipses, triangles, squares, pentagon, hexagons, slits, non-polygonal shapes, etc. The one or more apertures can be formed using any suitable operation such as, for example, punching, cutting, etc.

At block 1020, the process 1000 includes receiving a workpiece having one or more center apertures into machine or system (e.g., the system 950 of FIG. 9A). As shown, for example, in FIG. 9A, the workpiece is received between two or more forming tools (e.g., dies) in preparation for a compression and/or deformation operation. In one embodiment, for example, at least one of the forming tools has a forming portion aligned with at least one of the one or more center apertures formed in the workpiece.

At block 1030, the process 1000 includes forming a diaphragm (e.g., the diaphragm 960 of FIGS. 9C-9F) in the workpiece. As discussed above with reference to FIG. 9C, the diaphragm can be formed by moving a first forming tool toward a second forming tool that holds the workpiece. The first forming tool can impact and/or engage the workpiece and elastically deform a portion of the workpiece into a desired shape (e.g., an elliptical frustum shape).

At block 1040, the process 1000 can optionally include adjusting the size of the one or more center apertures in the diaphragm. As shown, for example, in FIGS. 9C and 9D, a size (e.g., a diameter) of one or more center apertures can increase from a first size (e.g., a diameter of the aperture 240' of FIG. 9C) to a second, greater size (e.g., the dimension D2 (FIG. 9F) of the aperture 940 of FIG. 9D). The size of the one or more apertures can be adjusted using any suitable means including, for example, punching the one or more apertures. In some embodiments, the second, greater size is selected based on removing portions of the workpiece adjacent the center aperture that may have received stress during the forming operations described above in reference block 1030.

At block 1050, the process 1000 can optionally include removing excess material from the workpiece. As shown, for example, in FIG. 9D the step(s) of producing the diaphragm 960 may result in excess edge material 962. The edge material can be removed as shown in FIG. 9E using any suitable means including, for example, cutting and/or trimming the edge material from the workpiece.

At block 1060, the process 1000 can optionally include additional treatment to the diaphragm prior to attachment to a transducer. In some embodiments, for example, the diaphragm is cleaned and anodized after formation.

Figure 11:
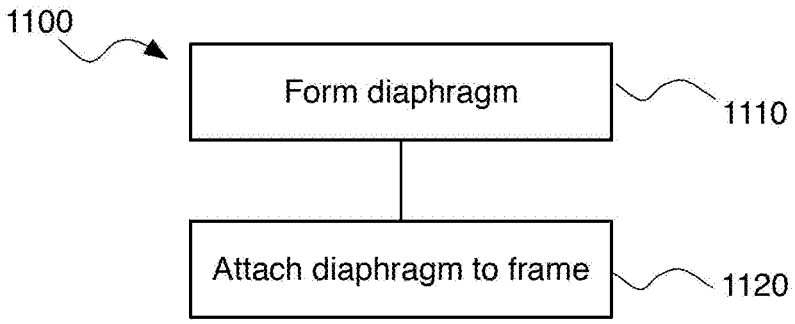
FIG. 11 is a flow diagram of a process of producing a transducer in accordance with an embodiment of the disclosed technology.

FIG. 11 is a flow diagram of a process 1100 of producing a transducer (e.g., the transducer 100 of FIG. 1). In some embodiments, the process 1100 comprises instructions stored on a non-transitory computer-readable memory that, when executed by one or more processors, can cause one or more machines and/or systems to perform one or more operations. In some aspects, a single machine or system can perform all the operations described below. In other aspects, the process 1100 may be performed by more than one machine or system. In some aspects, the process 1100 may include additional or fewer steps than the steps described below in reference to FIG. 11. Moreover, the steps shown in FIG. 11 do not necessarily denote an order to performing the steps.

At block 1110, the process 1100 includes forming a transducer diaphragm (e.g., the diaphragm 960 of FIG. 9F) as described above in reference to FIG. 10.

At block 1120, the process 1100 includes attaching the transducer diaphragm to a transducer frame (e.g., the frame 102 of. FIG. 1) having a magnet (e.g., the magnetic assembly 104 of FIG. 1). A transducer surround (e.g., the surround 112 of FIG. 1), for example, can attach an outer boundary of the diaphragm (e.g., the second boundary 962) to the frame. Attaching the diaphragm to the frame can further include, for example, operably coupling a voice coil (e.g., the voice coil 108 of FIG. 1) to an inner boundary of the diaphragm (e.g., the first boundary 970 of FIG. 9F). As discussed above in reference to FIG. 1, for example, operably coupling the diaphragm to the coil of wire surrounded by the magnet can allow the coil of wire to actuate the diaphragm in response to electrical signals received from an electrical signal source via terminals on the coil of wire (e.g., the terminals 107*a* and *b* of FIG. 1), thereby producing sound.

IV. Example Data

Figure 12B:
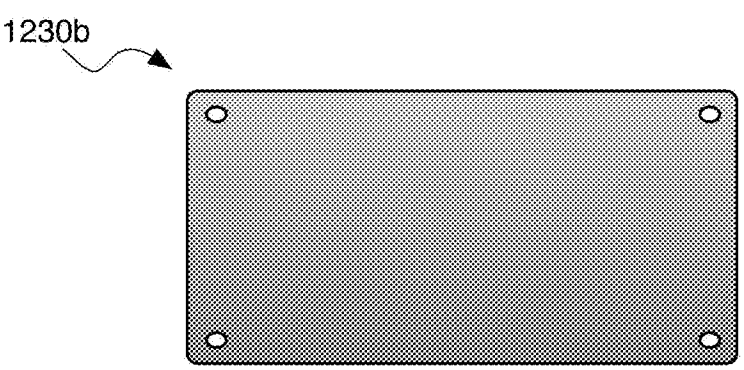
FIG. 12B is a top plan view of a conventional workpiece.
Figure 12A:
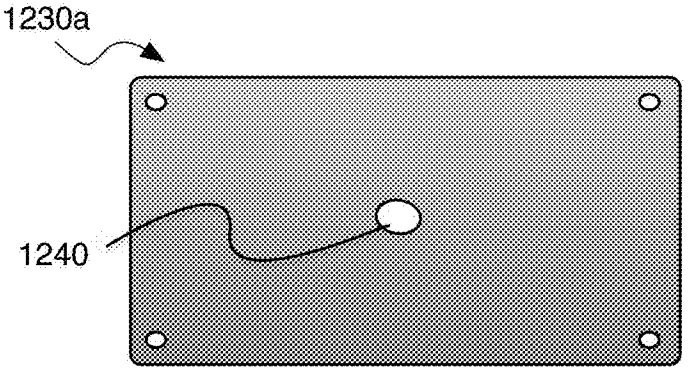
FIG. 12A is a plan view of a workpiece configured in accordance with an embodiment of the present disclosure.
Figure 12C:
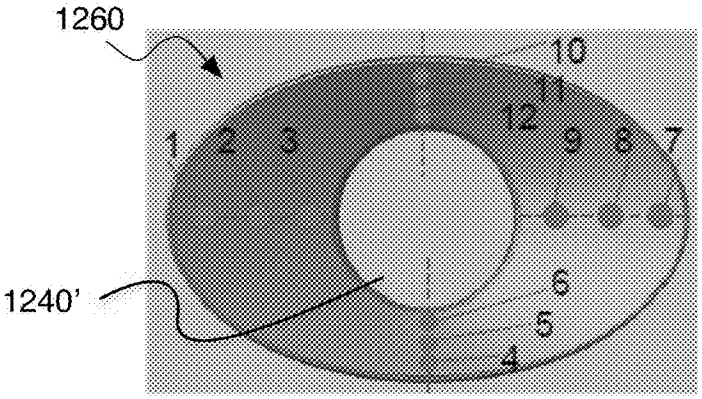
FIG. 12C is a top plan view of a transducer diaphragm configured in accordance with an embodiment of the disclosed technology.

FIG. 12A is a plan view of an enhanced workpiece 1230*a* configured in accordance with an embodiment of the present disclosure. FIG. 12B is a top plan view of a conventional workpiece 1230*b*. FIG. 12C is a top plan view of a transducer diaphragm 1260 having positions 1-12. Referring first to FIGS. 12A-12C together, the enhanced workpiece 1230*a* (FIG. 12A) includes a center aperture 1240 similar to the workpiece 230 and center aperture 240, respectively, discussed above in reference to FIG. 2B. The conventional workpiece 1230*b* (FIG. 12B), however, lacks a center aperture.

The enhanced workpiece 1230*a* and the conventional workpiece 1230*b* can each be formed into diaphragms having the shape of the diaphragm 1260 (FIG. 12C) having a center opening 1240' using the forming processes (e.g., stamping) discussed above in reference to FIGS. 9A and 10. The inventor has recognized that forming the enhanced workpiece 1230*a* with center aperture 1240 into the diaphragm 1260 can provide one or more benefits compared to a conventional technique of stamping the conventional workpiece 1230*b*. For example, diaphragms produced in accordance with the disclosed technology can be expected to have a lower variation of sidewall thickness and/or reduced likelihood of tearing compared to diaphragms produced using conventional techniques.

Figure 12D:
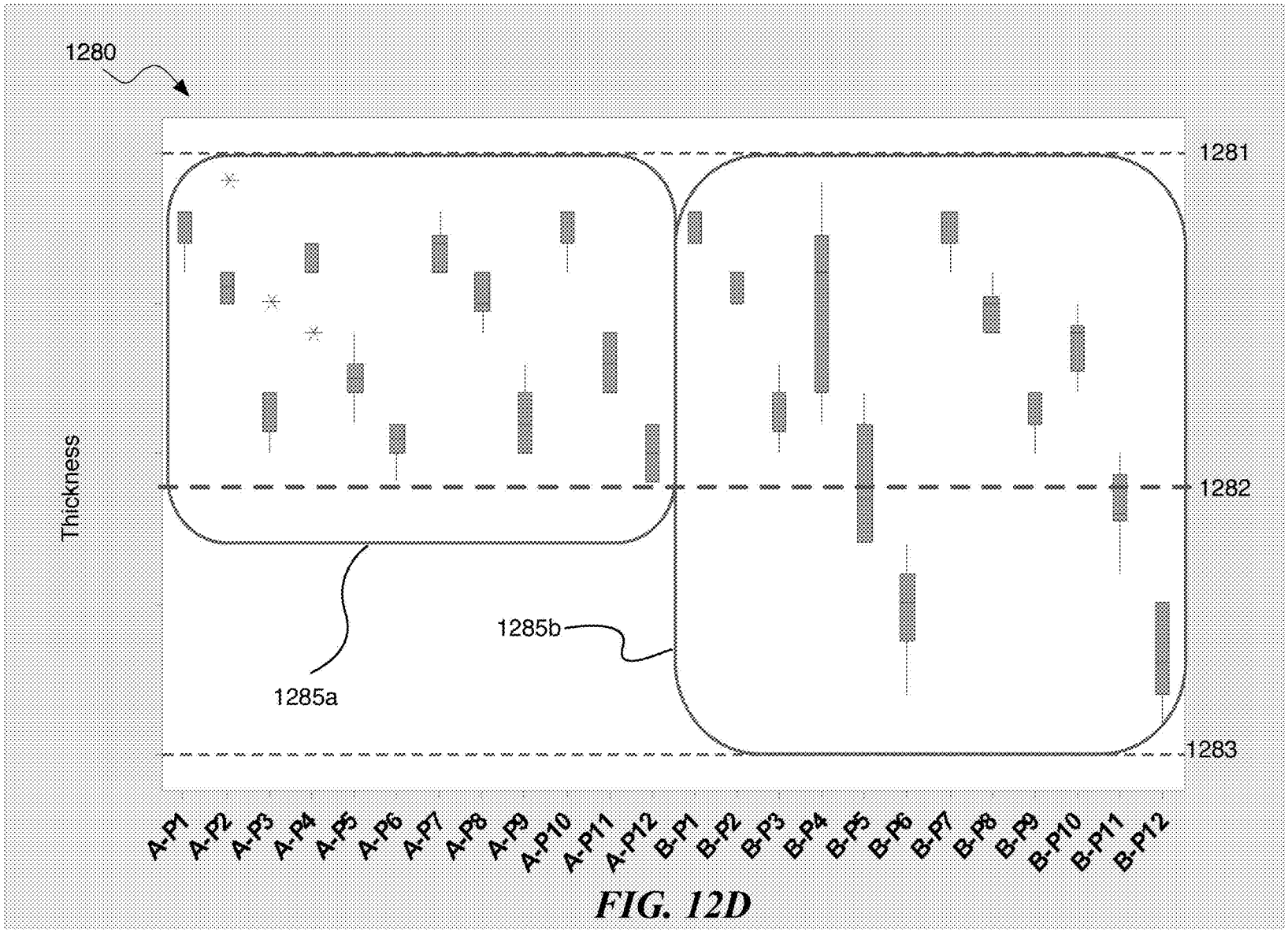
FIG. 12D is a graph showing transducer diaphragm dimensions at positions shown in FIG. 12C.

FIG. 12D is a graph 1280 showing relative transducer diaphragm thicknesses (along a y-axis) at the positions 1-12 (along an x-axis) shown in FIG. 12C. The thicknesses in the graph 1280 include a first thickness 1281 (e.g., approximately 0.15 mm), a second thickness 1283 (e.g., approximately 0.13 mm) and a threshold thickness 1282 (e.g., approximately 90% of the first thickness).

A first range 1285*a* of thicknesses includes the thickness of sidewalls of diaphragms produced using the enhanced workpiece 1230*a* (FIG. 12A) at the corresponding positions 1-12 shown in the diaphragm 1260 (FIG. 12C) based on the data shown in Table 1 below. A second range 1285*b* of thicknesses includes the thickness of sidewalls of diaphragms produced using the conventional workpiece 1230*b* (FIG. 12B) at the corresponding positions 1-12 shown in the diaphragm 1260 (FIG. 12C) based on data shown in Table 2 below. Ten diaphragms were produced using the enhanced workpiece 1230*a*, and ten diaphragms were produced using the conventional workpiece 1230*b*. As shown in the graph 1280, the thicknesses in the first range 1285*a* are greater than or equal to the threshold thickness at all positions 1-12, while thicknesses in the second range 1285*b* at at least positions 5, 6, 11, and 12 are less than the predetermined thickness 1282.

TABLE 1

Measured thicknesses at positions 1-12 in FIG. 12C for each of 10 diaphragms produced using the enhanced workpiece 1230a (FIG. 12A) in accordance with embodiments of the disclosed technology.

| # | A-P1 | A-P2 | A-P3 | A-P4 | A-P5 | A-P6 | A-P7 | A-P8 | A-P9 | A-P10 | A-P11 | A-P12 |
|---|---|---|---|---|---|---|---|---|---|---|---|---|
| 1 | 0.148 | 0.146 | 0.142 | 0.147 | 0.142 | 0.141 | 0.147 | 0.146 | 0.141 | 0.147 | 0.144 | 0.141 |
| 2 | 0.147 | 0.145 | 0.142 | 0.147 | 0.142 | 0.14 | 0.146 | 0.145 | 0.14 | 0.147 | 0.142 | 0.139 |
| 3 | 0.147 | 0.146 | 0.142 | 0.147 | 0.142 | 0.14 | 0.146 | 0.144 | 0.14 | 0.148 | 0.143 | 0.139 |
| 4 | 0.147 | 0.146 | 0.14 | 0.146 | 0.143 | 0.139 | 0.147 | 0.145 | 0.142 | 0.148 | 0.144 | 0.141 |
| 5 | 0.148 | 0.145 | 0.141 | 0.147 | 0.143 | 0.141 | 0.148 | 0.146 | 0.14 | 0.146 | 0.143 | 0.141 |
| 6 | 0.146 | 0.145 | 0.142 | 0.147 | 0.142 | 0.141 | 0.147 | 0.145 | 0.141 | 0.148 | 0.143 | 0.14 |
| 7 | 0.147 | 0.145 | 0.14 | 0.147 | 0.143 | 0.141 | 0.147 | 0.144 | 0.14 | 0.147 | 0.142 | 0.14 |
| 8 | 0.147 | 0.145 | 0.142 | 0.144 | 0.141 | 0.14 | 0.146 | 0.145 | 0.142 | 0.147 | 0.142 | 0.139 |
| 9 | 0.147 | 0.146 | 0.142 | 0.146 | 0.143 | 0.14 | 0.147 | 0.145 | 0.142 | 0.147 | 0.143 | 0.14 |
| 10 | 0.148 | 0.149 | 0.145 | 0.147 | 0.144 | 0.141 | 0.148 | 0.146 | 0.143 | 0.147 | 0.144 | 0.14 |

TABLE 2

Measured thicknesses at positions 1-12 in FIG. 12C for each of 10 diaphragms produced by stamping the conventional workpiece 1230b (FIG. 12B):

| # | B-P1 | B-P2 | B-P3 | B-P4 | B-P5 | B-P6 | B-P7 | B-P8 | B-P9 | B-P10 | B-P11 | B-P12 |
|---|---|---|---|---|---|---|---|---|---|---|---|---|
| 1 | 0.147 | 0.145 | 0.142 | 0.148 | 0.141 | 0.136 | 0.147 | 0.146 | 0.142 | 0.144 | 0.139 | 0.133 |
| 2 | 0.147 | 0.145 | 0.141 | 0.145 | 0.141 | 0.135 | 0.148 | 0.145 | 0.142 | 0.145 | 0.139 | 0.135 |
| 3 | 0.148 | 0.146 | 0.142 | 0.147 | 0.141 | 0.137 | 0.148 | 0.146 | 0.141 | 0.142 | 0.136 | 0.132 |
| 4 | 0.148 | 0.146 | 0.143 | 0.149 | 0.139 | 0.135 | 0.147 | 0.145 | 0.141 | 0.144 | 0.138 | 0.133 |
| 5 | 0.148 | 0.145 | 0.142 | 0.147 | 0.142 | 0.136 | 0.147 | 0.144 | 0.142 | 0.142 | 0.14 | 0.135 |
| 6 | 0.147 | 0.146 | 0.142 | 0.142 | 0.137 | 0.133 | 0.148 | 0.145 | 0.141 | 0.144 | 0.138 | 0.133 |
| 7 | 0.148 | 0.145 | 0.141 | 0.143 | 0.137 | 0.134 | 0.148 | 0.145 | 0.141 | 0.143 | 0.138 | 0.131 |
| 8 | 0.147 | 0.145 | 0.14 | 0.142 | 0.137 | 0.132 | 0.147 | 0.144 | 0.14 | 0.144 | 0.138 | 0.132 |
| 9 | 0.147 | 0.145 | 0.142 | 0.147 | 0.138 | 0.135 | 0.146 | 0.144 | 0.141 | 0.144 | 0.137 | 0.133 |
| 10 | 0.147 | 0.145 | 0.14 | 0.141 | 0.137 | 0.134 | 0.147 | 0.145 | 0.141 | 0.145 | 0.14 | 0.135 |

V. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

What is claim is:

1. A method of producing a transducer diaphragm, the method comprising:

positioning a workpiece between a first die and a second die, wherein the workpiece comprises metal having an inner boundary defining a center aperture having a first diameter;

compressing the workpiece between the first die and the second die to form the transducer diaphragm, wherein compressing the workpiece comprises increasing the first diameter of the center aperture to a second diameter; and after compressing the workpiece between the first die and the second die, increasing the second diameter of the center aperture to a third diameter.

2. The method of claim 1, further comprising:

prior to receiving the workpiece between the first die and the second die, punching out a center portion of the workpiece, thereby forming the center aperture.

3. The method of claim 1, wherein the transducer diaphragm has a generally elliptical frustum shape.

4. The method of claim 1, wherein the transducer diaphragm has a rotationally asymmetric shape.

5. The method of claim 1, wherein the transducer diaphragm has a side wall extending between a first base portion and a second base portion, wherein the side wall has a range of thicknesses including a minimum thickness and a maximum thickness, and wherein the minimum thickness is greater than or equal to a predetermined percentage of the maximum thickness.

6. The method of claim 5, wherein the predetermined percentage is 90% or greater.

7. The method of claim 1, wherein the workpiece comprises aluminum or an alloy thereof.

8. A method of producing a loudspeaker diaphragm, the method comprising:

removing a center portion of a workpiece to form an inner boundary defining a center aperture having a first diameter in the workpiece, wherein the workpiece comprises metal;

positioning the workpiece between a first forming tool and a second forming tool;

after removing the center portion, compressing the workpiece between the first forming tool and the second forming tool to form the loudspeaker diaphragm, wherein compressing the workpiece comprises increasing the first diameter of the center aperture to a second diameter; and after compressing the workpiece between the first forming tool and the second forming tool, removing an inner boundary portion of the workpiece to increase the second diameter of the center aperture to a third diameter.

9. The method of claim 8, wherein compressing the workpiece further comprises:

receiving the workpiece between the first forming tool and the second forming tool;

axially aligning a forming portion of the first forming tool with the center aperture; and actuating the forming portion of the first forming tool toward the center aperture of the workpiece and the second forming tool.

10. The method of claim 8, wherein the loudspeaker diaphragm has a generally elliptical frustum shape.

11. The method of claim 8, wherein the loudspeaker diaphragm has a rotationally asymmetric shape.

12. The method of claim 8, wherein the loudspeaker diaphragm has a side wall extending between a first base portion and a second base portion, wherein the side wall has a range of thicknesses including a minimum thickness and a maximum thickness, and wherein the minimum thickness is greater than or equal to 90% of the maximum thickness.

13. The method of claim 8, wherein removing the center portion of the workpiece comprises removing a portion of the workpiece having a generally circular shape.

14. The method of claim 8, wherein removing the center portion of the workpiece comprises removing a portion of the workpiece having an asymmetric polygonal shape.

15. The method of claim 8, wherein removing the center portion of the workpiece comprises forming a slit in the workpiece.

16. The method of claim 1, wherein increasing the second diameter of the center aperture to a third diameter comprises punching the workpiece.

17. The method of claim 1, wherein increasing the second diameter of the center aperture to a third diameter comprises cutting the workpiece.

18. The method of claim 8, wherein removing the inner boundary portion of the workpiece to increase the second diameter of the center aperture to a third diameter comprises punching the workpiece.

19. The method of claim 8, wherein removing the inner boundary portion of the workpiece to increase the second diameter of the center aperture to a third diameter comprises cutting the workpiece.

* * * * *